United States Patent [19]

Van den Plas et al.

[11] 4,236,045

[45] Nov. 25, 1980

[54] ELECTRIC LAMP

[75] Inventors: Roger J. Q. Van den Plas; Pieter Hokkeling, both of Eindhoven, Netherlands

[73] Assignee: U.S. Philips Corporation, New York, N.Y.

[21] Appl. No.: 75,857

[22] Filed: Sep. 17, 1979

[30] Foreign Application Priority Data

Sep. 18, 1978 [NL] Netherlands ..... 7809459
Mar. 1, 1979 [NL] Netherlands ..... 7901630

[51] Int. Cl.[3] ..... H01K 1/38

[52] U.S. Cl. ..... 174/50.61; 65/59 R; 313/331

[58] Field of Search ..... 174/50.61, 50.64, 152 GM; 313/317, 318, 331; 403/30; 65/59 R

[56] References Cited

U.S. PATENT DOCUMENTS

| | | | |
|---|---|---|---|
| 2,402,927 | 6/1946 | Stupakoff | 174/152 GM |
| 2,811,576 | 10/1957 | Hodgdon et al. | 174/50.61 X |
| 3,007,121 | 10/1961 | Schlicke | 174/152 GM X |
| 3,448,320 | 6/1969 | Millikan | 313/318 X |
| 3,448,322 | 6/1969 | Millikan et al. | 313/331 X |

FOREIGN PATENT DOCUMENTS 1103056 2/1968 United Kingdom .

*Primary Examiner*—B. A. Reynolds
*Assistant Examiner*—D. A. Tone
*Attorney, Agent, or Firm*—Robert S. Smith

[57] ABSTRACT

In electric lamps a type of glass is used for the envelope which, in many cases, has a coefficient of expansion which differs considerably from that of the current supply conductors. Therefore, special measures have to be taken to seal the lamp envelope in a vacuum-tight manner around the current supply conductors.

The invention provides a simple, vacuum-tight seal of a lamp envelope (1), which seal consists of a metal plug (8, 9, 11) which is sealed both to the glass of the lamp envelope (1) and to the current supply wires (4, 5, 10).

The metal plug (8, 9, 11) of 100 parts by weight of a first metal (tin and/or lead) 0.05–1 parts by weight of a second metal (titanium, zirconium, hafnium, niobium, tantalum, and vanadium) has a strong adhering power and a large ductility.

2 Claims, 4 Drawing Figures

PHN 9233C

ELECTRIC LAMP

The invention relates to an electric lamp comprising a glass lamp envelope having a pinch, through which pinch a current supply wire extends directly from outside the lamp envelope to an electric element accommodated inside the lamp envelope, the said current supply wire being surrounded outside the lamp envelope by a metal plug which is sealed to the current supply wire.

Such a lamp is disclosed in U.S. Pat. Spec. No. 3,448,320. The known lamp is an incandescent lamp in which the current supply wires to the filament are formed by the limbs of the filament itself. In order to prevent the ends of the very thin current supply wires projecting outside the lamp envelope from oxidizing and fusing upon passage of current, because they are exposed to the air, they are enveloped by a metal plug which has a melting point between 600° and 1500° C.

In this known lamp the metal plug serves as a heat sink and furthermore as a means to mechanically reinforce the very thin current supply wire. The metal plug does not serve for the vacuum-tight sealing of the lamp envelope around the current supply wire. The above-mentioned specification states that, as a result of contraction of the metal plug opon cooling after providing the plug, no hermetic seal of the metal plug to the glass of the lamp envelope is obtained.

In this known lamp the vacuum-tight seal of the lamp envelope around the current supply wires is obtained by a special process step during pinching the lamp envelope, in which the current supply wires are heated to a very high temperature. As a result of this, a vacuum-tight seal of the lamp envelope can be obtained when using very thin current supply wires in spite of considerable differences in coefficients of thermal expansion between the metal of the current supply wire and the glass of the lamp envelope.

As a result of the very large differences in coefficients of thermal expansion between the metals used for the current supply wires (mainly tungsten and molybdenum) and the glasses used for lamp envelopes (mainly quartz glass and hard glasses), it has been necessary in practice to use complicated constructions to obtain vacuum-tight seals. For example, molybdenum foils are incorporated in the pinches of lamps having a quartz glass lamp envelope, to which foils respective external and internal current conductors are welded. This construction requires welded joints to be made which have each to be checked for their reliability, and results in a non-rigid assembly which impedes the accurate positioning of the electric element in the lamp envelope. In addition it imposes restrictions on the maximum permissible value of the lamp current. In this construction the lamp envelope is sealed in a vacuum-tight manner to the molybdenum foil, due to the ductility of molybdenum and the shape of the foil, but a capillary space extends around the external current conductor up to the foil via which space oxygen and moisture can reach the foil. As a result of this the foil may be oxidized and cracking of the pinch may occur.

In the case of hard glass lamp envelopes, current supply wires are used which are previously provided with a thin glass coating. The advantage of this construction is substantial rigidity which permits accurate positioning of the electric element in the lamp envelope, but the provision of the glass coating is an expensive step in the manufacture of the lamps.

It is the object of the invention to provide electric lamps having a very simple current leadthrough construction.

Accordingly, the invention provides an electric lamp of the kind described in the opening paragraph which is characterized in that the metal plug comprises at least one metal selected from a first group consisting of tin and lead, mixed with at least one metal selected from a second group consisting of titanium, zirconium, hafnium, niobium, tantalum and vanadium, the weight ratio between the metal(s) of the first and the second groups being 100:0.05 to 100:1, and in that the metal plug is sealed to the glass of the pinch.

In contrast with the metal plug of the known lamp, the metal plug used in the lamp according to the invention seals the lamp envelope hermetically around the current supply wire. This is the case in spite of the large differences in coefficients of thermal expansion of the glass of the lamp, the metal of the current supply wire, and the metals of the plug. The hermetic seal is due to the ductility of the metal plug which is derived from the first group metal(s) and to the good adhesion both to the glass and to the metal which is derived from the second group metal(s). These properties are expressed optimally in a weight ratio of first group metal(s) and second group metal(s) in the metal plug of 100:0.05 to 100:1.

The metal plug of the above stated composition is suitable to form the only sealing means of a lamp envelope. This is remarkable because, when a lamp has been filled with a gas having a pressure of, for example, 2.5 bar at room temperature, the gas pressure in operation of the lamp increases to approximately 10 bars. In contrast with the known lamp in which the seal of the lamp envelope is realized on the very thin current supply conductor to the filament and the metal plug fulfils no sealing function, one is free to choose the diameter of the current supply conductor in a lamp according to the invention on the basis of other parameters which are of significance for the satisfactory operation of the lamp, for example a low current density in the current supply conductor.

The melting point of the metal is approximately 235° C. for plugs containing tin only as a first group metal, becomes higher according as the quantity of lead in the plug is larger than the quantity of tin, to approximately 330° C. for plugs containing only lead as a first group metal.

Lamps having an operating pressure of approximately 1 bar can be operated in circumstances in which the temperature of the metal plug increases to values exceeding the melting temperature of the metal. According as the operating pressure of the lamp is higher, however, the temperature of the metal plug during operation of the lamp will be kept lower, below the melting point. This can, for example, be realized by ensuring a good heat exchange with the lamp surroundings, for example a luminaire.

The comparatively low melting point of the metal plugs facilitates the manufacture of the lamp. A suitable method of manufacture consists in that a lamp envelope having pinched current supply wires and an electric element is heated, at least locally where the metal plug is provided, to above the melting point of the metal mixture, after which the metal mixture is provided, for example, as a wire or a helical spring formed therefrom. The lamp envelope may be cooled as soon as the metal mixture has fused, flowed, and sealed itself to the current supply wire and to the glass of the pinch of the lamp envelope. The metals of the plug need not be mixed homogeneously before they are provided. For example, a tin-coated wire of lead and titanium may be used, subject to the above-defined weight ratio. The provision of the metal plug takes place, for example at 1000° C. in a reducing or neutral atmosphere, for example in nitrogen or argon. The plug is then obtained in some ten seconds.

In a case that the current supply wire, at least at the area of the metal plug consists of one of the second metals (the current supply wire may be, for example, a butt-welded wire which from the pinch inwardly consists of tungsten and from the pinch outwardly consists of niobium) the defined constituent mixture for the plug may be obtained in situ by providing and melting a first metal around the second metal of the supply wire, so that the first and second metals mix in the required ratio.

The lamps according to the invention include both incandescent lamps and discharge lamps.

The metal plug may be present at the end face of the pinch, that is to say on the part of the outer surface of the pinch from which the current supply conductors emerge and which extends transversely to the axis of the lamp. It is alternatively possible, however, as is the case with the lamp of the above-mentioned U.S. Patent Specification, to form in the pinch around the current supply wire a cavity in the end face and to provide the metal plug therein entirely or for the greater part.

It is to be noted that non-pre-published Netherlands Patent Application No. 7,802,796 (PHN 9070) describes an electric lamp in which the same metal plug is provided around the external current conductor. In this lamp, however, a molybdenum foil to which the glass of the pinch seal of the lamp envelope is sealed hermetically is present in the pinch. An internal and an external current supply conductor are welded to the foil. Therefore, the metal plug in this lamp does not primarily serve for the vacuum-tight seal of the lamp envelope which is already sealed in a vacuum-tight manner to the foil) but to protect the foil from oxidation by oxidizing agents which might penetrate to the molybdenum foil via the capillary space around the external current conductor.

It is furthermore noted that a soldered joint between quartz glass and molybdenum, tungsten or tantalum is known from British Patent Specification No. 1,103,056. The solder consists of 2 to 3% by weight of titanium and 98 to 97% by weight of tin. In the joint described in this Patent Specification, a quartz glass disk is surrounded by a molybdenum ring and secured thereto with the interposition of solder in a vacuum at 1,000° C. Since molybdenum, tungsten and tantalum have a very much higher coefficient of expansion than quartz glass, the solder, after cooling, is under a compressive stress.

Experiments have confirmed that this soldered joint is vacuum-tight. However, if it is endeavoured to make a joint with the same solder and in an identical manner in which quartz glass surrounds the metal, it is found that the joint is by no means tight. In this case, as a result of the larger shrinkage of molybdenum, tungsten and tantalum, tensile stresses arise in the solder upon cooling. Apparently the solder does not offer sufficient resistance thereto.

In the lamps according to the invention the soldered joint is also under a tensile stress. It would be expected that vacuum-tightness is not obtained either in this case. Surprisingly, however, a vacuum-tight joint is obtained indeed when a metal plug is used of the composition hereinbefore defined, with a so much lower content of second metal.

Embodiments of lamps according to the invention will now be described with reference to the accompanying drawing, of which:

Figure 1:
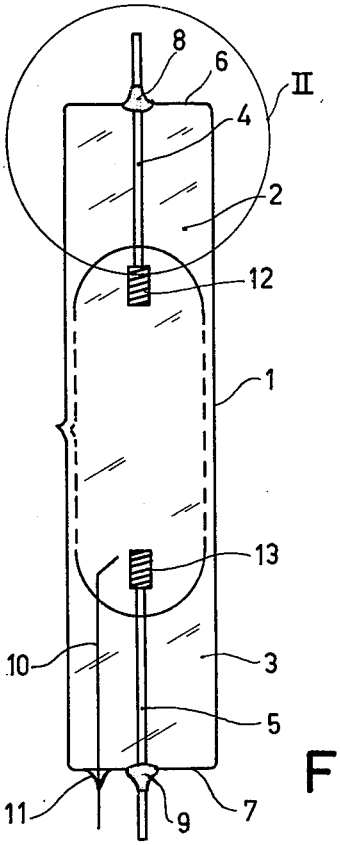
FIG. 1 is a front elevation of a high-pressure discharge lamp.
Figure 4:
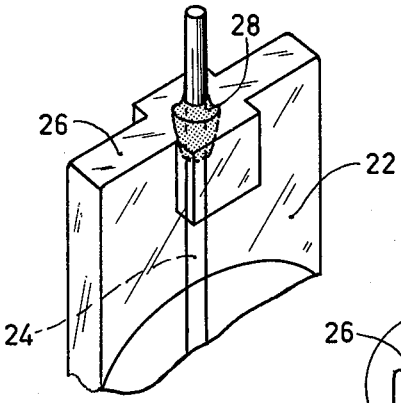
FIG. 4 is a perspective view of a detail of FIG. 3.

The lamp envelope 1 shown in FIG. 1 has two pinches 2 and 3 through which respective current supply wires 4 and 5 extend into the lamp envelope. Metal plugs 8 and 9 are provided on respective end faces 6 and 7 of the pinches around the current supply wires 4 and 5. These plugs, together with a metal plug 11 around a current supply wire 10 serving as an auxiliary electrode, seal the lamp envelope in a vacuum-tight manner. The current supply wires 4 and 5 support the electrodes 12 and 13, respectively.

Figure 2:
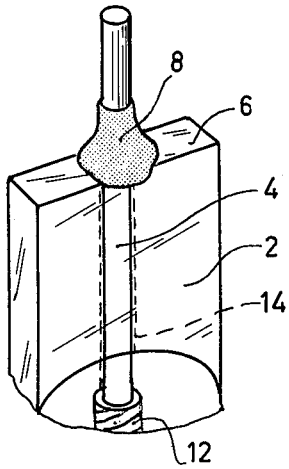
FIG. 2 is a perspective view of a detail of FIG. 1.

The reference numerals of FIG. 2 correspond to those of FIG. 1. The capillary around the current supply wire 4 is referenced 14.

Figure 3:
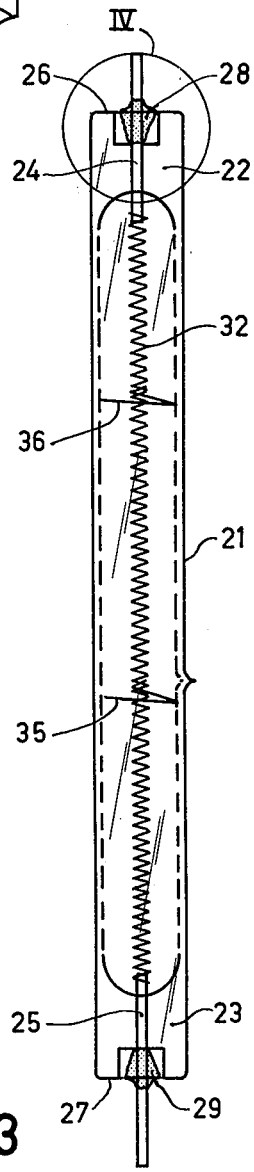
FIG. 3 is an elevation of an incandescent lamp.

In FIG. 3, a lamp envelope 21 has pinches 22 and 23 surrounding current supply wires 24 and 25, respectively. Conical cavities opening into the end faces 26 and 27, respectively, and filled with metal plugs 28 and 29, respectively, are recessed in each of the pinches 22 and 23. The plugs are sealed both to the glass of the relevant pinch and to the relevant current supply wire. A filament 32 centered between its ends by supporting members 35 and 36 is stretched in the lamp envelope between the current supply wires.

In each of the embodiments, the metal plugs comprised at least one metal selected from a first group consisting of tin and lead mixed with at least one metal selected from a second group consisting of titanium, zirconium, hafnium, niobium, tantalum, and vanadium; the weight ratio between the metal(s) of the first and second groups being 100:0,05 to 100:1.

EXAMPLE

A quartz glass tube having an exhaust tube was provided at each end with a respective pinch in each of which a tungsten current supply wire of 800 μm diameter was accommodated. A 220 V 1000 W filament was stretched between the current supply wires.

Upon making each of the pinches, a cavity opening into the end face was recessed.

The lamp was arranged vertically and argon was introduced through the exhaust tube. The uppermost pinch was heated to 1,000° C., whereupon a wire of lead with 1% by weight of titanium was contacted with the quartz glass of the pinch and the current supply wire. After the lead-titanium mixture had flowed into the cavity, the lamp was cooled and the opposite end was treated in the same manner.

The lamp was filled with 2.5 bars of argon containing 0.3% by volume of $CH_2Br_2$. The lamp was operated horizontally as a flood-light lamp both with and without a luminaire, the temperature of the metal plugs being 260° and 150° C., respectively.

In an analogous manner a lamp was manufactured having a metal plug consisting of tin having 0.05 and 0.1% by weight, respectively, of titanium. The pinch was heated at 1,000° C. in a current of $N_2/H_2$ (92/8 vol/vol) as a protective gas. A vacuum-tight joint was obtained in all cases.

What is claimed is:

1. An electric lamp having a glass lamp envelope with a pinch through which pinch a current supply wire extends directly from outside the lamp envelope to an electric element accommodated inside the lamp envelope, the said current supply wire being surrounded outside the lamp envelope by a metal plug sealed to the current supply wire, characterized in that the metal plug comprises at least one metal selected from a first group consisting of tin and lead mixed with at least one metal selected from a second group consisting of titanium, zirconium, hafnium, niobium, tantalum, and vanadium, the weight ratio between the metal(s) of the first and second groups being 100:0.5 to 100:1, and in that the metal plug is sealed to the glass of the pinch.

2. An electric lamp as claimed in claim 1, characterized in that the metal from said first group is lead.

* * * * *